United States Patent [19]

Traister et al.

[11] Patent Number: 4,611,816

[45] Date of Patent: Sep. 16, 1986

[54] CARGO HANDLING SYSTEM

[75] Inventors: Martin S. Traister, Lexington; James R. Fay, Marlboro; Charles E. Becher, Brookline; John M. Calligeros, Winchester, all of Mass.; Foster R. Harris, Dayton, Ohio; Kevin M. Powderly, Weilerbach, Fed. Rep. of Germany; Joseph M. Nicholson, Medford, Mass.

[73] Assignee: The United States of America as represented by the Secretary of the Air Force, Washington, D.C.

[21] Appl. No.: 659,484

[22] Filed: Oct. 10, 1984

[51] Int. Cl.[4] ..... B60P 3/40

[52] U.S. Cl. ..... 280/43.2; 280/47.13 R; 414/458

[58] Field of Search ..... 280/43.2, 47.13 R, 43.24, 280/43.23; 414/458, 786, 498

[56] References Cited

U.S. PATENT DOCUMENTS

| | | | |
|---|---|---|---|
| 883,139 | 10/1906 | Robinson | 193/42 |
| 2,968,490 | 1/1961 | Baus | 280/35 |
| 3,541,598 | 11/1970 | Dousset | 214/392 |
| 3,631,999 | 1/1972 | Walerowski | 414/458 |
| 3,844,578 | 10/1974 | Matyskella et al. | 280/43.22 |
| 3,972,439 | 8/1976 | DiMartino | 214/10.5 R |
| 4,392,662 | 7/1983 | Hoglinger | 280/43.23 |
| 4,452,555 | 6/1984 | Calabro | 414/458 |
| 4,516,901 | 5/1985 | Riedl | 414/458 |

FOREIGN PATENT DOCUMENTS

| | | | |
|---|---|---|---|
| 2369202 | 6/1978 | France | 414/458 |
| 2458505 | 2/1981 | France | 414/458 |

OTHER PUBLICATIONS

Engineering catalog C-21-C from Joyce-Cridland Company.

Line Fast Corporation Tandemloc Connector, Mar. 1983.

*Primary Examiner*—David M. Mitchell

*Attorney, Agent, or Firm*—Donald J. Singer; Jacob N. Erlich

[57] ABSTRACT

A cargo handling system having three major components: (1) a plurality of loading jack assemblies, (2) a plurality of stationary jack assemblies, and (3) a tow bar. The loading jack assemblies are of a novel construction so as to be removably mounted upon a cargo to be loaded or unloaded from the cargo bay of an aircraft or if desired onto a flat bed trailer truck. During the loading and unloading procedure a plurality of uniquely constructed stationary jack assemblies are utilized in conjunction with the loading jack assemblies so as to aid in the loading and unloading operation. By use of the combination of removable loading jack assemblies and stationary jack assemblies, cargo can be quickly loaded and unloaded into and from a minimum of space.

4 Claims, 9 Drawing Figures

FIG. 2
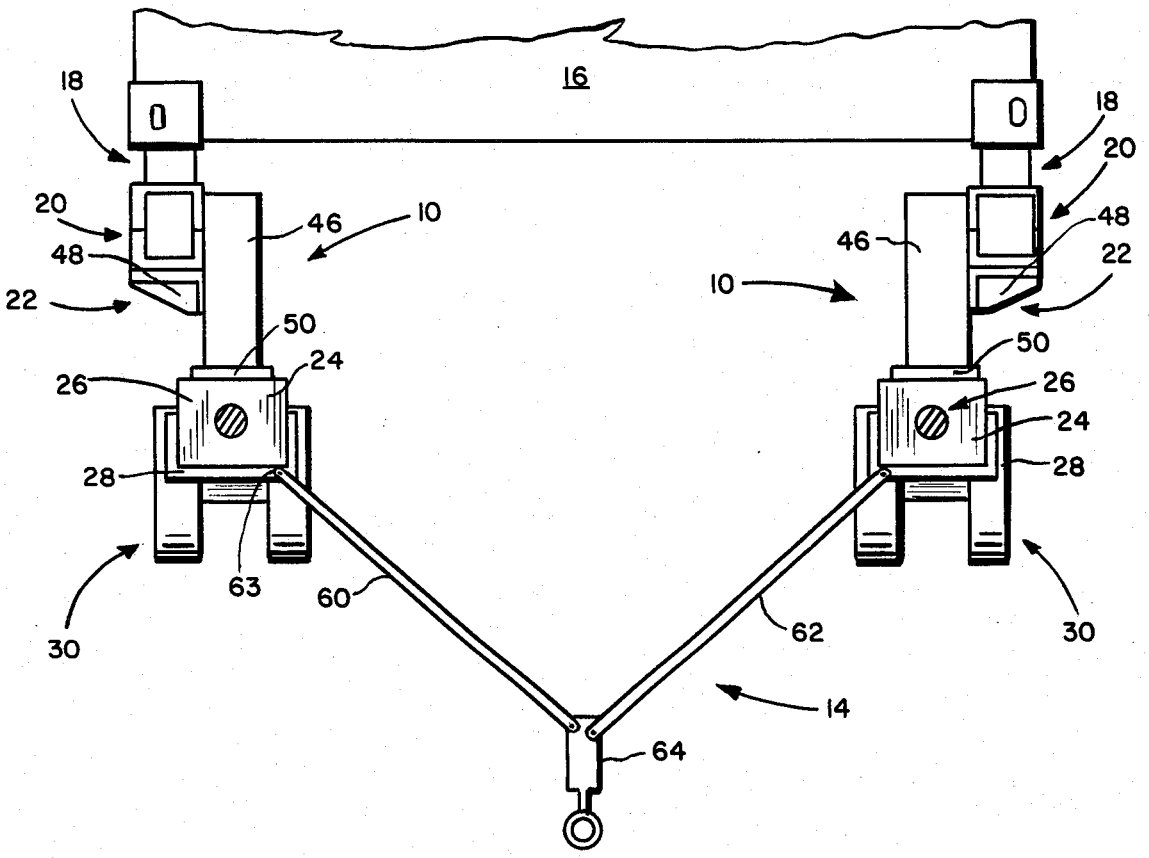
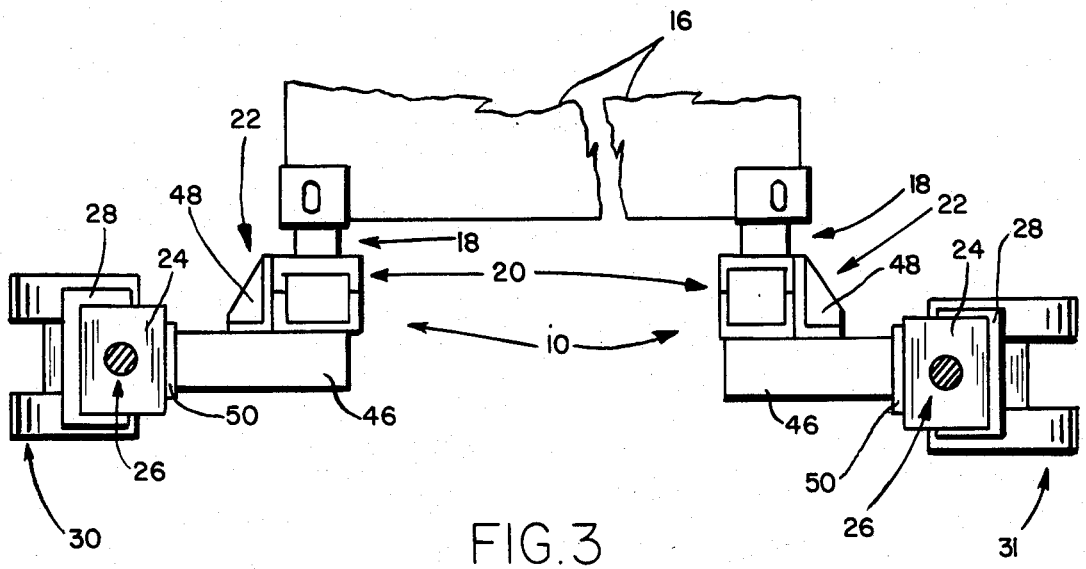
FIG. 3

FIG. 8
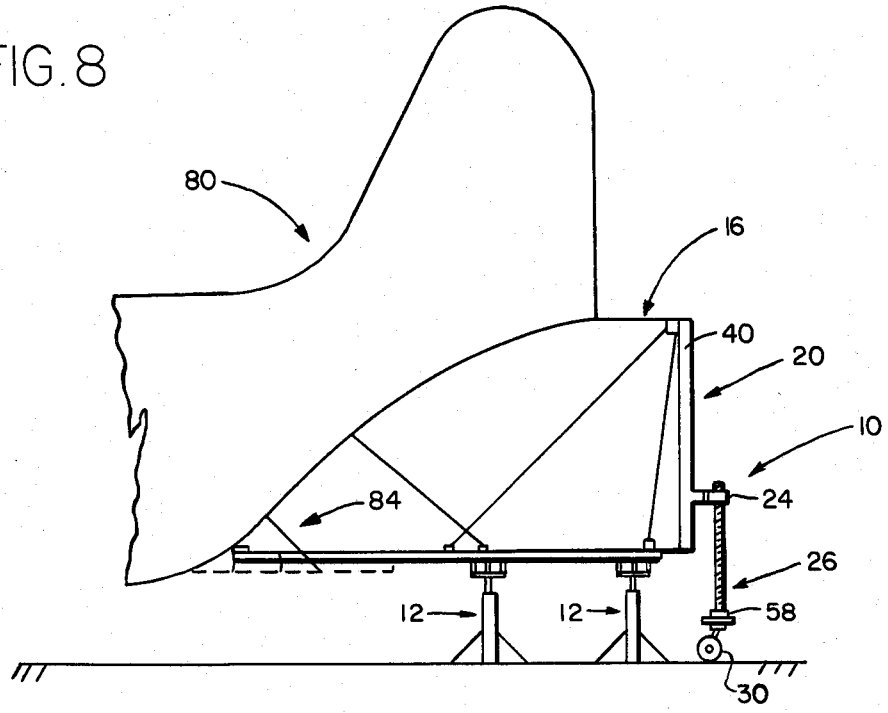
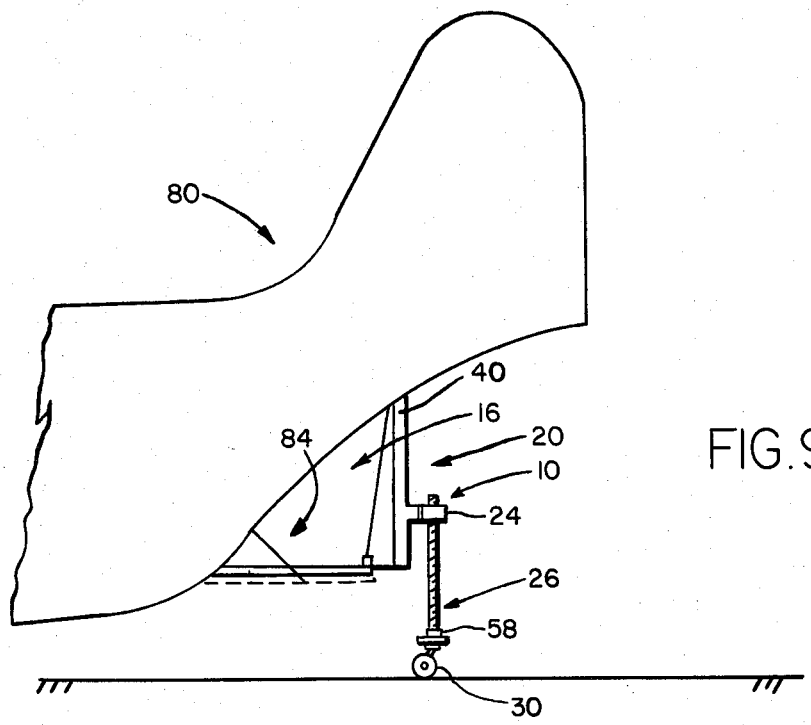
FIG. 9

CARGO HANDLING SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates generally to a cargo handling system, and, more particularly, to a cargo handling system which includes a plurality of novel cargo handling apparatus capable of efficiently loading tactical shelters on a cargo aircraft.

There are many instances when it becomes desirable to both load and unload cargo from either a cargo aircraft or a flat bed trailer truck. A specific type of cargo which appears to pose a greater handling problem than ordinarily encountered is commonly referred to as an International Standards Organization (ISO) tactical shelter. Such an ISO tactical shelter is generally used as a mobile shack capable of housing electronic repair facilities or the like. With the increasing need for such mobile tactical shelters at remote locations the attendant requirement for efficient air transportation becomes more critical. Unfortunately, past cargo handling systems of these shelters leaves much to be desired.

For example, past cargo handling systems permanently affixed dollies or mobilizers to the tactical shelters. Since these dollies or mobilizers remained attached to the shelters during transport the number of shelters which were transportable in a particular aircraft was substantially reduced. In addition, since tactical shelters find utility in a wide variety of places throughout the world, in many of these places it was unlikely to find or have material or handling equipment capable of transporting, unloading or loading these tactical shelters from aircraft.

Consequently, a great need has recently arisen to provide not only an apparatus for efficiently loading and unloading tactical shelters or other similar type cargo from aircraft or the like, but also to provide a system which is capable of efficiently performing such loading and unloading operations.

SUMMARY OF THE INVENTION

The present invention overcomes the problems encountered in the past and as set forth in detail hereinabove by providing not only the apparatus necessary for the efficient loading and unloading of cargo but also an extremely effective cargo handling system which utilizes such cargo handling apparatus in performing such loading and unloading operations.

Although the present invention finds its main utility in conjunction with typical ISO tactical shelters or shipping containers, it should be understood that this invention can be readily adapted to be used with other similar type of cargo. Prior to describing the system of this invention for loading and unloading such cargo, the following brief summary describes the novel apparatus or cargo handling components utilized with the system of the present invention.

In general, an ISO tactical shelter or other similar cargo has located at each of the corners thereof an opening for receiving hooking elements utilized for loading or unloading the cargo. Consequently in order to utilize the system of the present invention it is necessary to provide a plurality of connectors, preferably in the form of conventional "Tandemloc Connectors," (eight in number) of the type described in U.S. Pat. No. 3,972,439 which are each capable of engaging a respective opening at a corner of the cargo and to which the remaining components or apparatus of the system of the present invention can be attached.

A plurality of elongated columns (four in number) are provided for removable engagement with the above-mentioned connectors. Each of these columns are mounted vertically between a pair of oppositely disposed connectors. In this manner there will be four such columns associated with each of the tactical shelters or cargo to be moved.

Removably affixed to each of the columns is a uniquely designed cross-member capable of mounting thereto a jack/wheel unit. The cross-member and/or column may be mounted in a variety of positions with respect to the cargo in order to appropriately mount the jack/wheel unit with respect thereto. One such arrangement would involve mounting the jack/wheel unit in two distinct, separate positions. Situated at the bottom of the jack is an adapter plate which allows a caster and wheel arrangement to be affixed thereto thereby forming the jack/wheel unit. In this manner each corner of the tactical shelter or cargo will have removably affixed thereto a cargo handling apparatus made up of the above-described elements and hereinafter referred to as the removable or loading jack assembly of the cargo handling system of this invention.

In addition, another component or apparatus of the cargo handling system of the present invention is a stationary jack assembly which is utilized during the removal or loading of cargo from an aircraft in a manner to be set forth hereinbelow. The stationary jack assembly includes a jack which is capable of having a spring unit mounted thereon and a roller fixture mounted on the spring unit. The stationary jack assembly is utilized to support the cargo during the loading or unloading of the cargo from an aircraft in conjunction with the loading jack assembly in a manner to be described hereinbelow.

The system of the present invention finds its main utility in loading or unloading ISO tactical shelters from a cargo aircraft or, in some instances, a flat bed truck. Cargo loading begins with the tactical shelter or cargo sitting on the ground. Each of the four removable or loading jack assemblies is attached to respective corners of the shelter. The loading jacks are used to raise or lower the tactical shelter and have a throw or range of approximately 66 inches. Consequently, the loading jack assemblies may be affixed to the shelter either when resting on the ground or at a height of up to 66 inches.

Once the loading jack assemblies are appropriately affixed to the cargo, a tow bar is connected to the corner edge of each a pair of the loading jacks. The tow bar is also connected to a tug truck in order to roll the tactical shelter or cargo into position adjacent the opening of a cargo aircraft or the like. Once in position adjacent the opening of the cargo aircraft, the wheels of the loading jack are locked in position, the shelter is then raised by means of the jacks so that it is directly adjacent the opening of the cargo aircraft. In that position the stationary jack assemblies are placed underneath the cargo and raised so as to have their rollers snugly engage the bottom of the cargo. Thereafter, the pair of loading jack assemblies nearest the aircraft are removed and using an aircraft which the shelter or load is pulled into the aircraft. The stationary jack assemblies are removed and the cargo is continually pulled into the aircraft. As the shelter nears its fully loaded position the remaining loading jack assemblies are also removed. In this manner the tactical shelter or cargo is within the aircraft with no loading means associated therewith. To unload the shelter from the aircraft the above procedure is merely reversed.

When the present invention is utilized in loading a cargo onto a flat bed truck, the loading jack assemblies are positioned with respect to the cargo such that the flat bed trailer of the truck can be driven directly under the raised cargo without being obstructed by the loading jack assemblies.

It is therefore an object of this invention to provide a cargo loading or unloading system.

It is another object of this invention to provide cargo handling components or apparatus for effectively loading and unloading cargo from a cargo aircraft, truck or the like.

It is still a further object of this invention to provide a cargo handling system in which the cargo handling components are easily removed from the cargo.

It is still a further object of this invention to provide a cargo handling system in which the components thereof are economical to produce and which utilizes conventional, currently available components that lend themselves to standard mass producing manufacturing techniques.

For a better understanding of the present invention, together with other and further objects thereof, reference is made to the following description, taken in conjunction with the accompanying drawings and its scope will be pointed out in the appended claims.

BRIEF DESCRIPTION OF THE DRAWINGS

FIG. 2 is a plan view, shown partly in segmented fashion, of a pair of loading jack assemblies of the cargo handling system of this invention attached in a first position to a cargo;

FIG. 3 is a plan view, shown partly in segmented fashion, of a pair of loading jack assemblies of the cargo handling system of this invention attached in a second position to a cargo;

FIG. 8 is a pictorial, schematic representation of a cargo being partially loaded into a cargo aircraft by means of the cargo handling system of this invention; and FIG. 9 is a pictorial, schematic representation of the cargo being substantially loaded into a cargo aircraft and being supported by only the rear pair of loading jack assemblies of the cargo handling system of this invention.

DETAILED DESCRIPTION OF THE PREFERRED EMBODIMENT

In order to clearly understand the cargo handling system of the present invention it is first necessary to provide a detailed description of the apparatus of this invention utilized in conjunction with and forming part of the cargo handling system. Basically, the cargo handling system incorporates therein three major apparatus or components: (1) a plurality of loading jack assemblies 10, (2) a plurality of stationary jack assemblies 12, and (3) a tow bar 14.

Figure 1:
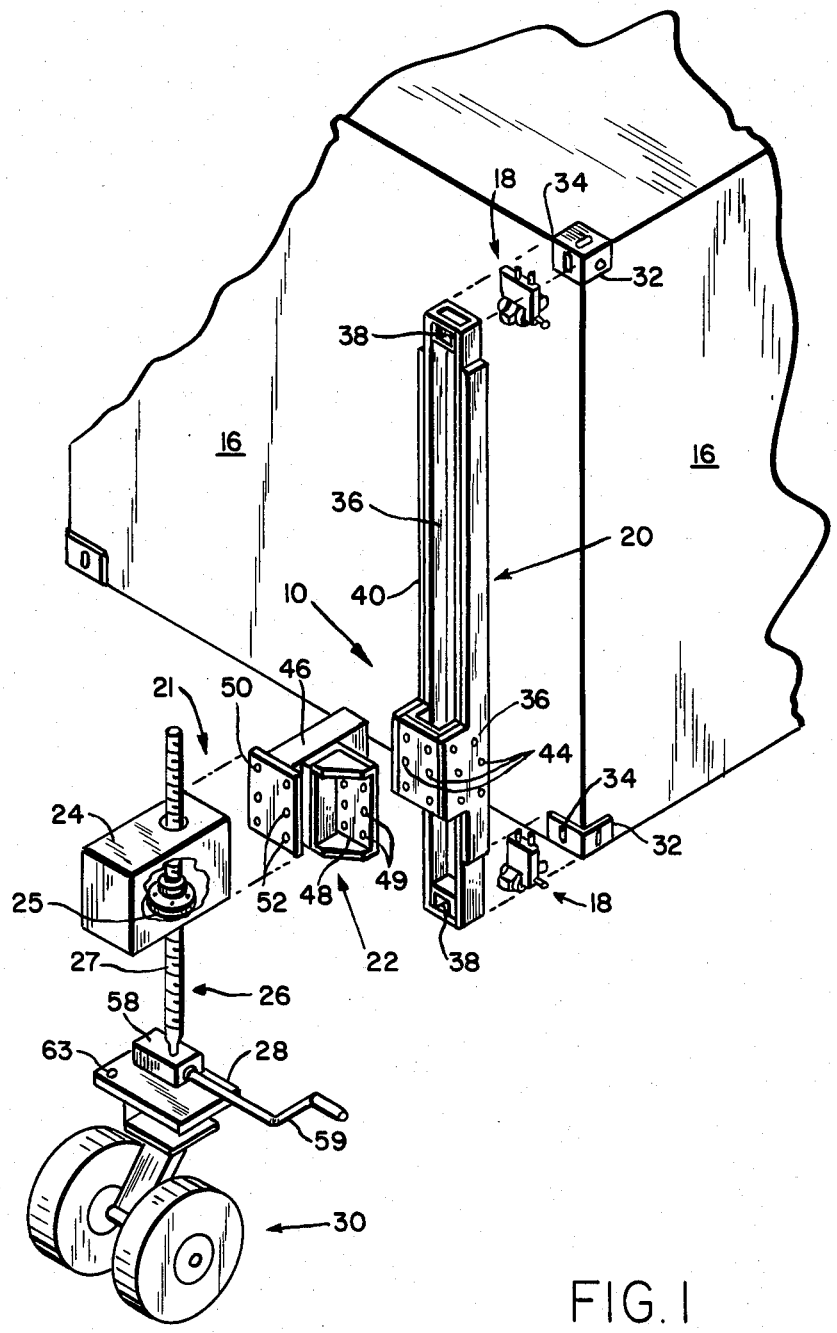
FIG. 1 is an exploded pictorial illustration of one of a plurality of loading jack assemblies of the cargo handling system of this invention.

Reference is first made to FIG. 1 of the drawings which pictorially illustrates one of a plurality of loading jack assemblies 10 which can be removably affixed to each of the four corners of a cargo 16 to be handled. Although it is preferable that the present invention be utilized with an International Standards Organization (ISO) tactical shelter or ISO shipping container, it should be realized that this invention is also capable of handling many other types of cargo upon the application of suitable adaptations at the attachment points. Therefore throughout the specification the terms tactical shelter and cargo may be used interchangeably.

Still referring to FIG. 1 of the drawings, although four loading jack assemblies 10 are utilized with the present invention, for simplicity, only one such loading jack assembly 10 is shown in FIG. 1 of the drawings. Furthermore, since all four of the loading jack assemblies 10 are identical in construction the following description will refer to only one of such loading jack assembly 10 in which the components thereof will be set forth in detail. There are six main components of each loading jack assembly 10 of the present invention: (1) a conventional Tandemloc Connector 18 of the type described in U.S. Pat. No. 3,972,439 and incorporated herein by reference, (2) a support column 20 capable of removable connection to the Tandemloc Connector 18, (3) a structural interface 21 in the form of, for example, an adjustably movable cross-member 22 for removable connection to support column 20 and jack housing 24, (4) a conventional screw-type jack 26 with traveling nut, such as produced by the Joyce-Cridland Co, and sometimes referred to as a "traveling nut/jack," (5) a jack/caster adapter plate 28, and (6) a conventional caster and wheel unit 30.

When cargo loading or unloading by the cargo handling system of the present invention is to take place, it is first necessary to attach to each of the upper and lower four corners 32 of a (tactical shelter) cargo 12 one of the plurality of the loading jack assemblies 10, respectively, of the present invention. In order to do so it is first necessary to utilize separate conventional Tandemloc Connectors 18 which have one arm thereof engageable within an opening 34 located at both the top and bottom of each corner 32 of the tactical shelter 16. In other words, there is a Tandemloc Connector 18 attached to the bottom of each of the four corners 32 of tactical shelter 16 and a Tandemloc Connector 18 attached to the upper corners of each of the four corners 32 of tactical shelter 16.

Interposed between a pair of oppositely vertically disposed Tandemloc Connectors 18 at each corner of the tactical shelter 12 is a support column 20. Each support column 20 is made up of a elongated frame-like structure 36 having a pair of block-like openings 38 at each end thereof. Openings 38 allow for the engagement therein of the other of the arms of each of the Tandemloc Connectors 18. By such an interconnection, support columns 20 may be removably attached to either the front and rear, or opposed sides of cargo 16. Elongated body 36 of support column 20 contains a plurality of openings 44 therein utilized for the interconnection thereto of the cross member 22.

As can be seen from FIG. 1 of the drawings cross member 22 is made up of T-shaped element 46 having an extension 48 protruding therefrom. Extension 48 has openings 49 therein and is positioned substantially midway between the ends of the T-shaped element 46. In its protruding position, extension 48 can be positioned and attached to support block 42 of support column 20 in two distinct and separate positions. It can be mounted either directly in front of support 20 as illustrated pictorially in FIGS. 1 and 2 of the drawings or it can be moved to a position perpendicular thereto in the manner illustrated in FIG. 3 of the drawings. A flat plate 50 forming the upper portion of the T-shaped member 46 also has a plurality of openings 52 to which can be affixed jack housing 24.

As illustrated in FIG. 1 of the drawings, jack housing 24 fixedly encompasses the traveling nut 25 of screw jack 26 so as to permit movement to take place between housing 24 (and nut 25) and threaded rod 27. A detailed description of screw-type jack 26 with traveling nut 25 is not given since it is conventional in its design and is available from the Joyce-Cridland Co. The base of the jack 26 is in the form of a crank housing 58 which contains crank 59 therein. This type of screw jack 26 is readily actuatable either manually by crank 59, or electrically, hydraulically, or pneumatically. A jack/caster adapter plate 28 is bolted to one side of housing 58 with the caster and wheel unit 30 being secured to the other side thereof. In this manner the caster and wheel unit 30 can be easily removed or connected to jack 26. Each of the loading jack assemblies 10 can be easily attached or removed from the tactical shelter 12 in a manner to be described in greater detail hereinbelow.

Continuing with the description of the components or apparatus making up the cargo handling system of the present invention is a tow bar 14 more clearly illustrated in FIG. 2 of the drawings. The tow bar 14 is of a Y-shaped configuration having legs 60 and 62 pivotably extending from an eye assembly 64. The legs 60 and 62 are removably securable to a pair of the flat adapter plates 28, respectively, by way of openings 63 therein. The loading jack assemblies 10 are generally secured to the cargo or tactical shelter 16 in a position such that the wheel and caster units 30 extend in a direction parallel to the longitudinal axis of the cargo 16. FIG. 3, on the other hand, illustrates the loading jack assemblies 10 being attached to cargo 16 in a position such that wheel and caster units 30 extend perpendicular to the above-mentioned longitudinal axis of the cargo 16. Alternatively, by mounting support columns 20 to the sides of cargo 16 caster units 30 can be made to extend perpendicular to the longitudinal axis of cargo 16. In this manner cargo 16 can be easily loaded onto a flat bed truck.

Figure 4:
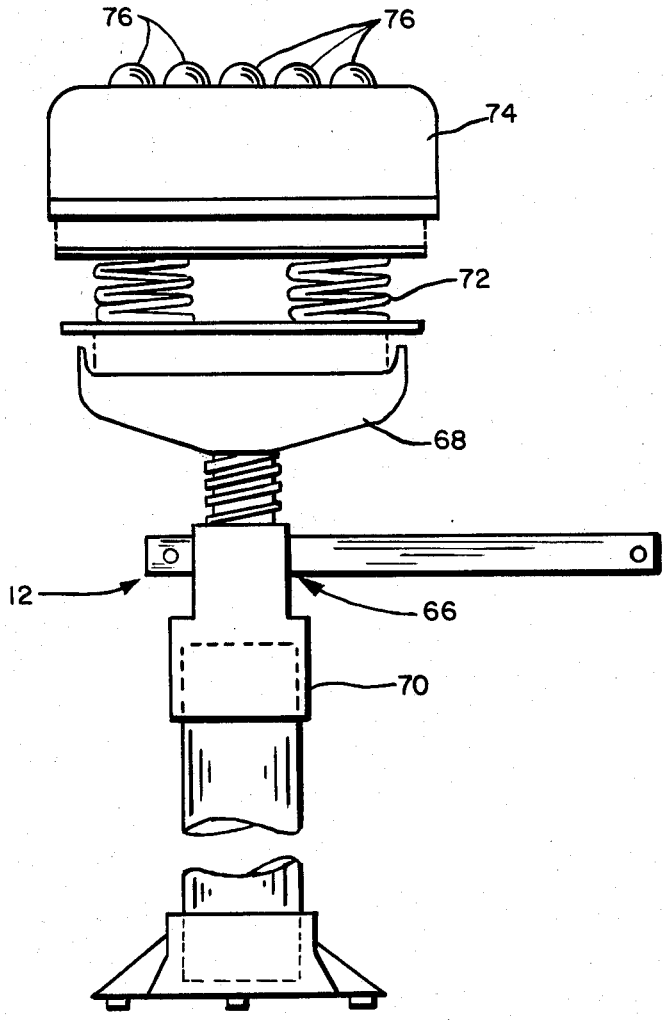
FIG. 4 is a side elevational view, shown in exploded fashion, of one of a plurality of stationary jack assemblies of the cargo handling system of this invention.

Reference is now made to FIG. 4 of the drawings which clearly illustrates the stationary jack assembly 12 utilized in conjunction with the cargo or tactical shelter 16 when the tactical shelter 16 is being loaded into or unloaded from a cargo aircraft or the like in a manner to be described hereinbelow. Stationary jack assembly 12 includes a jack 66 having a jack head 68 movable with respect to body 70 of the jack 66; a removable spring unit 72 which may be utilized in conjunction with the jack head 68; and a roller fixture 74 which includes a plurality of rollers 76. During operation, the spring unit 72 is positioned on top of jack head 68 and roller fixture 74 is mounted upon the spring unit 72. Alternatively, a plurality or stationary jacks may be interconnected to form a single stationary jack unit.

MODE OF OPERATION

Figure 5:
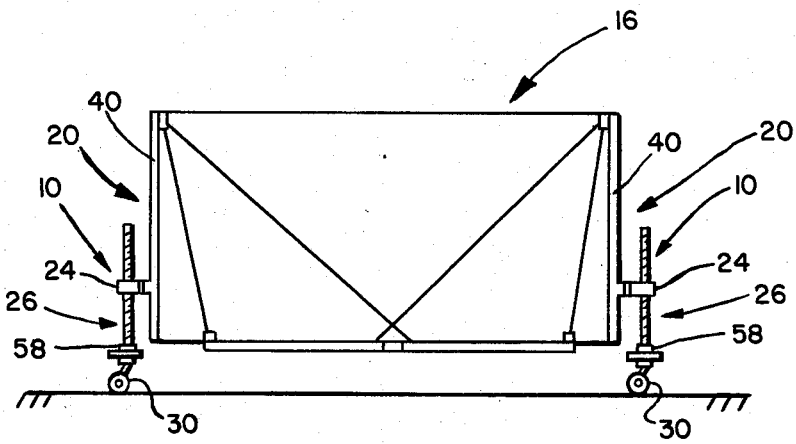
FIG. 5 is a pictorial, schematic representation of a cargo having the loading jack assemblies of the cargo handling system of this invention attached thereto.

In order to best describe the operation of the complete cargo handling system of this invention reference will now be made to FIGS. 5–9 of the drawings. FIG. 5 of the drawings clearly illustrates the tactical shelter 16 having the plurality of loading jack assemblies 10 secured thereto. In other words, four such loading jack assemblies 10 are utilized with each shelter or cargo 16.

Figure 6:
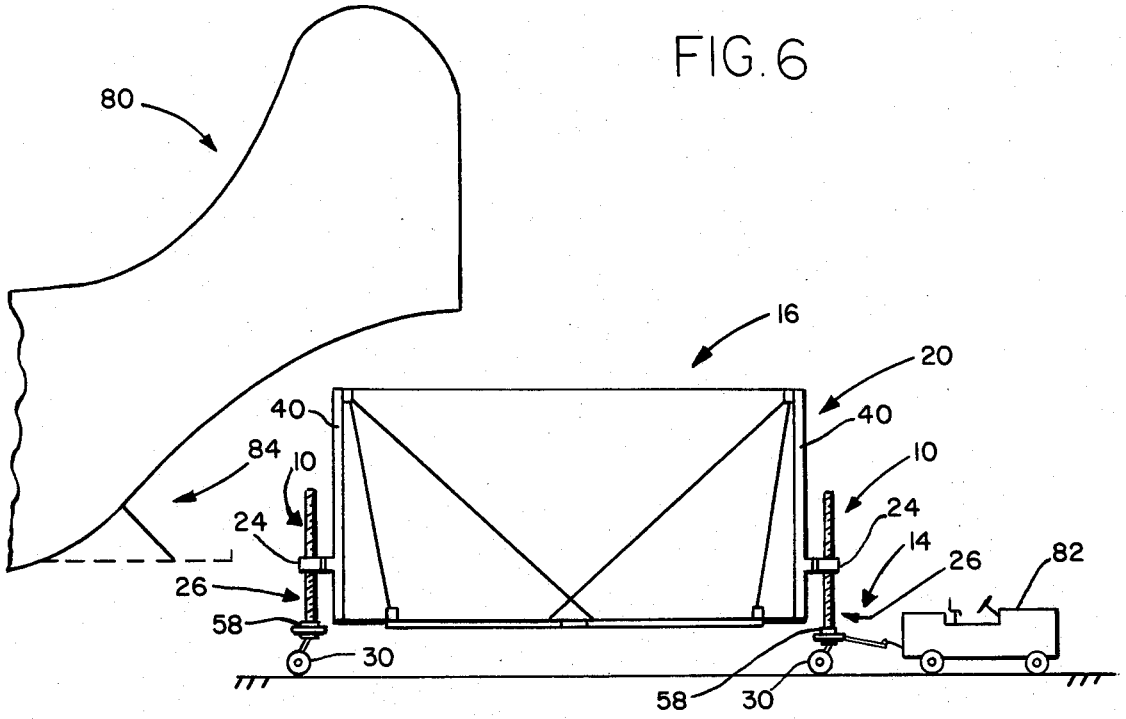
FIG. 6 is a pictorial, schematic representation of a cargo being positioned adjacent the loading opening of a cargo aircraft with the cargo handling system of this invention.

Referring to FIG. 6 of the drawings any suitable tug truck or vehicle 82 having tow bar 14 affixed thereto and to a pair of loading jack assemblies 10 can move tactical shelter 16 to a position adjacent the cargo opening 84 of, for example, cargo aircraft 80. Once in its position as shown in FIG. 6 adjacent cargo opening 84 the next step in loading cargo 16 with the cargo handling system of this invention can be undertaken.

Figure 7:
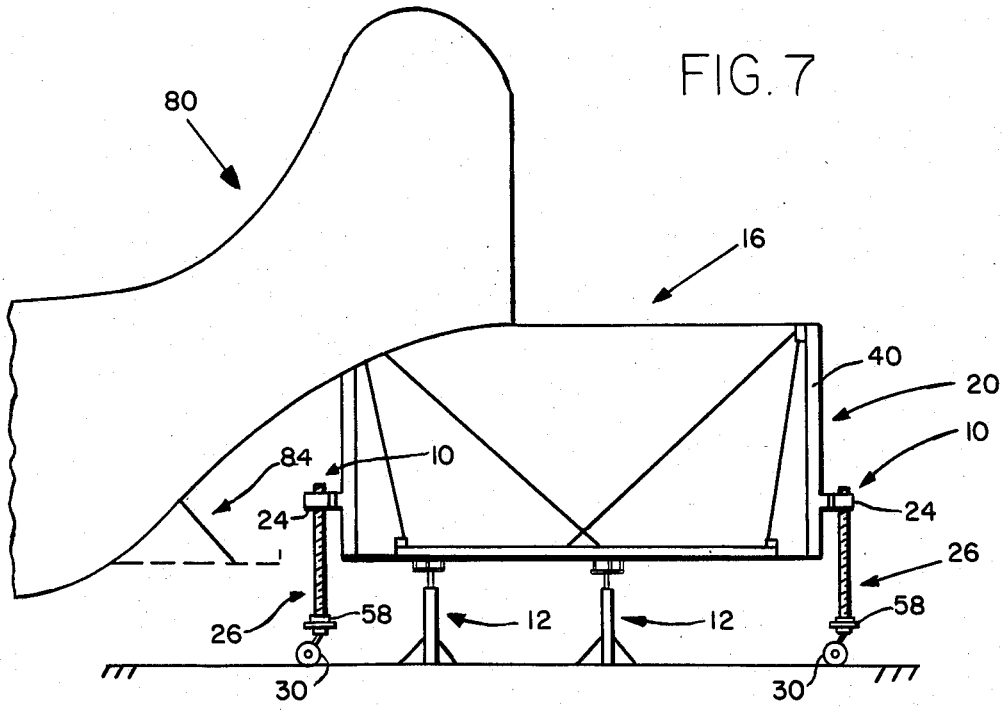
FIG. 7 is a pictorial, schematic representation of a cargo being raised and placed upon the stationary jack assemblies of the cargo handling system of this invention prior to loading into a cargo aircraft.

Cargo or tactical shelter 16 is raised to its desired height by means of loading jack assemblies 10. Thereafter an appropriate number of stationary jack assemblies 12, as illustrated in FIG. 7 of the drawings, are utilized to aid in the loading operation. Once the stationary jack assemblies 12 have been positioned beneath tactical shelter 16 they can be jacked up to snugly fit beneath tactical shelter 16 so that the weight of tactical shelter 16 is supported not only by loading jack assemblies 10 but also by stationary jack assemblies 12.

Reference is now made to FIG. 8 of the drawings in which the pair of loading jack assemblies 10 closest opening 84 of the cargo aircraft 80 are removed. In this position, the tactical shelter 16 rests upon stationary jack assemblies 12 and the rear loading jack assemblies 10. In this supporting position, the tactical shelter 16 can then be partially inserted into cargo opening 84.

As shown in FIG. 9 of the drawings, as the cargo 16 is loaded into the aircraft 80, preferably by means of a winch (not shown) within aircraft 80, the stationary jack assemblies 12 can be sequentially removed. As is evident from FIG. 9, tactical shelter 16 is now almost completely within the cargo bay of cargo aircraft 80 with only the last pair of loading jack assemblies 10 supporting the rear of shelter 16. Thereafter, the last pair of loading jack assemblies 10 are removed as the cargo or tactical shelter 16 is completely inserted within the cargo aircraft 80. With the cargo handling system of the present invention it is possible to load three such tactical shelters 16 on board a cargo aircraft 80 where, in the past, it was only possible to load two such tactical shelters in the same space.

When removing tactical shelter 16 from aircraft 80 the steps which were referred to above are merely reversed. For example, referring first to FIG. 9 of the drawings, upon the extraction of a portion of tactical shelter 16 from aircraft 80 the pair of end loading jack assemblies 10 with roller and caster units 30 in place are secured to the rear portion of tactical shelter 16. Thereafter the tactical shelter 16 is retracted from cargo aircraft 80 by another tug vehicle 82 or, in some instances, by manpower. Upon a substantial amount of tactical shelter 16 being removed from cargo opening 84, stationary jack assemblies 12 are inserted therebeneath as shown in FIG. 8 of the drawings. In this manner the tactical shelter 16 may be further removed from aircraft 80. Upon the complete removal of tactical shelter 16 as shown in FIG. 7 of the drawings the last pair of loading jack assemblies 10 are secured to the other end of tactical shelter 16 so that the tactical shelter now rests not only on stationary jack assemblies 12 but also on loading jack assemblies 10. Thereafter, one either raises tactical shelter 16 by means of loading jack assemblies 10 or lowers stationary jack assemblies 12 so that stationary jack assemblies 12 can be removed. The tactical shelter 16 can now be easily towed or transported by other convenient means (as shown in FIG. 6) to any desired location for use.

If it is desirable to load shelter or cargo 16 on board a flat bed truck, with the present invention it is only necessary to move the jack 26 and caster and wheel units 30 to the side of the cargo 16 in order for the flat bed trailer to be driven under the cargo 16 when the cargo is in its raised position. Such a rearrangement of the jack and caster wheel units can be accomplished as shown in FIG. 3 of the drawings, or as mentioned above the entire loading jack assembly 10 including support columns 20 can be attached to the sides of cargo 16.

Although this invention has been described with reference to a particular embodiment and method, it will be understood that this invention is also capable of further and other embodiments within the spirit and scope of the appended claims.

We claim:

1. A jack assembly for use in the loading and unloading of cargo, comprising:

a jacking mechanism, said jacking mechanism including a jack and caster/wheel unit removably secured thereto;

means operably connected to said jacking mechanism for removably securing said jacking mechanism to said cargo in two different orientations, said removable securing means including a support column, means interposed between said jacking mechanism and said support column for affixing said jacking mechanism to said support columnin two distinct and separate positions with respect to said suport column, said affixing means including a member having a first and a second end, said first end thereof being affixed to said jacking mechanism, said member having an extension protruding therefrom and being positioned substantially midway between said first and said second ends, said extension having a flat surface thereon for attachment to said support column at said two distinct and separate positions in order to provide said two different orientations of said jacking mechanism with respect to said cargo, and means for removably attaching said support column to said cargo in at least one position.

2. A jack assembly as defined in claim 1 wherein said support column comprises an elongated frame-like structure having a pair of block-like openings at each end thereof for receiving said removable attaching means therein, and means for attaching thereto said affixing means.

3. A jack assembly as defined in claim 1 wherein said support column comprises an elongated frame-like structure having a pair of block-like openings at each end thereof for receiving said removable attaching means therein, and a mounting plate substantially circumscribing said elongated frame-like structure for attaching thereto said affixing means.

4. A jack assembly as defined in claim 1 wherein said jacking mechanism further comprises a jack/caster mounting plate, said jack/caster mounting plate having an opening therein for attaching a tow thereto.

* * * * *